United States Patent [19]

Dickerson

[11] Patent Number: 4,696,086

[45] Date of Patent: Sep. 29, 1987

[54] DIE SET APPARATUS FOR BADGES

[76] Inventor: John W. Dickerson, 16480 Burleigh Pl., Brookfield, Wis. 53005

[21] Appl. No.: 821,474

[22] Filed: Jan. 22, 1986

[51] Int. Cl.[4] ..... B23P 11/00

[52] U.S. Cl. ..... 29/243.52

[58] Field of Search ..... 72/347, 452; 29/243.5, 29/243.52, 251, 267

[56] References Cited

U.S. PATENT DOCUMENTS

| | | | |
|---|---|---|---|
| 3,571,891 | 3/1971 | Roberts | 29/243.52 |
| 3,600,783 | 8/1971 | Krinsky | 29/243.52 |
| 3,795,036 | 3/1974 | Roebuck | 29/243.52 |
| 4,077,284 | 3/1978 | Twichell | 29/251 |
| 4,346,507 | 8/1982 | Heuck | 29/243.52 |

*Primary Examiner*—Robert C. Watson

*Attorney, Agent, or Firm*—Fuller, Puerner & Hohenfeldt

[57] ABSTRACT

A die set for assembling badges and buttons includes a punch and two dies. The badge shell and artwork are loaded onto the first die. The punch descends during a loading stroke to load the shell and artwork therein by friction. The second die is positioned under the punch, and the punch descends during an assembly stroke. The punch includes a block attached to the assembly machine ram and a spring loaded punch ring. The second die has a base a spring loaded crimp ring. The punch ring abuts the crimp ring during the assembly stroke. The punch block descends further, but the punch ring remains stationary against the crimp ring springs. The shell and artwork are thus partially pushed out of the punch and into the second die. Continued downward punch block motion overcomes the crimp ring springs and causes both the punch ring and crimp ring to move downwardly together, thereby pushing the shell and artwork over the badge back. The invention includes a manually operated press having a variable mechanical advantage with the maximum mechanical advantage occurring at the conclusion of the assembly stroke. The invention further includes a pneumatic circuit for automatically ejecting the assembled badges from the second die at the completion of the assembly stroke.

13 Claims, 15 Drawing Figures

161
165
167
123
163
171
173
159
8
125
175
177
157
3
179
5
7
127

DIE SET APPARATUS FOR BADGES

BACKGROUND OF THE INVENTION

1. Field of the Invention

This invention pertains to badge manufacturing, and particularly to apparatus for assembling a plurality of components into unitary laminated badges.

2. Description of the Prior Art

Various equipment has been developed to manufacture badges and buttons for fastening on clothing by means of safety-like pins. Prior badge manufacturing apparatus typically requires several operations involving various cumbersome manipulations. For example, U.S. Pat. No. 4,299,019 discloses a die set combination for making badges that requires at least three manual inversions of the die set combination during the assembly process. It is apparent that the apparatus of the U.S. Pat. No. 4,299,019 is not suited for low cost, high volume badge production.

Other drawbacks of prior die sets include non-interchangability of the dies between automatic and manually operated badge making machines. Also, various parts of some known die sets, including those of the U.S. Pat. No. 4,299,019 are held together by manually actuated latches of different types. Manual latching and unlatching operations are inefficient and inappropriate for high production.

Prior machines for use in connection with the die sets are also handicapped by various deficiencies. Some known machines require manual or other mechanically induced rotation of the die punch to provide resistance to punch motion during the assembly process. Such rotation requires either fatiguing manipulations of the punch by the machine operator or expensive mechanisms to rotate the punch under power. Some prior machines are capable of automatically assemblying badges by properly positioning the die sets in synchronization with the punch motion, but such machines employ costly and complicated drive components for positioning the dies. For example, one known machine uses two separate motors and drive mechanisms that are clutched together to synchronize the punch and die motions. Repeated engagement and disengagement of clutches is inefficient and causes clutch wear, which eventually results in timing problems.

Thus, a need exists for badge making equipment suitable for efficent high volume button and badge assembly.

SUMMARY OF THE INVENTION

In accordance with the present invention, a die set is provided that is capable of reliably and inexpensively assembling buttons and badges on a high production basis. This is accomplished by apparatus that includes a punch adapted to sequentially cooperate with a pair of dies with a minimum of manipulations of the punch and dies during operation. The die set is advantageously used with an automatic badge assemblying machine having a single power source for driving all the components thereof in a continuous and reliable fashion.

The first die includes an anvil having a flat horizontal support surface, radially spaced from the periphery of the support surface so as to form an open top annular groove. Surrounding the support surface is a circular retaining ring.

The punch comprises a hollow, circular punch ring having a disk portion and a hollow hub axially extending from the disk portion. The punch ring hub is adapted to enter the annular groove in the first die to surround the horizontal support surface. The punch ring is mounted for reciprocation along the inner diameter thereof on the hub of a punch block. Springs interposed between the punch block and punch ring tend to push the punch ring off the block hub. However, fastening means limit the travel of the punch ring on the block, so that the punch ring can reciprocate between a first position wherein the springs are fully compressed and a second position wherein the springs are partially released. The face of the punch block hub is formed with a relatively shallow concave frusto-conical surface. In the initial conditions, the punch ring hub extends beyond the block frusto-conical end face to create a recess therewith.

The second die includes a face having a flange portion and a hub extending upwardly from the flange. The hub has a recessed upper support surface. Adapted to reciprocate vertically on the hub is a hollow crimp ring provided with a counterbore that terminates in a tapered surface. The crimp ring is biased upwardly from the base flange by springs, and fastener means limit the upward travel of the crimp ring. Thus, the crimp ring is reciprocable between a first position wherein the springs are fully compressed and a second position wherein the springs are partially released. The spring force of the springs of the second die is greater than the spring force of the springs of the punch.

The punch and first die cooperate during a first portion of a badge manufacturing cycle to load a badge front shell and artwork in the punch for final assembly to the badge back. For that purpose, a preformed badge shell is placed face up on the anvil support surface of the first die, and the flat artwork is superimposed on the shell. The punch is brought down upon the first die so that the hub of the punch ring folds the edges of the artwork around the shell periphery and also exerts a slight radial pressure on the shell periphery. The punch is then withdrawn from the first die, and the artwork and shell remain captured in the punch recess.

During the second portion of the manufacturing cycle, the artwork and shell loaded in the punch are assembled to the badge back, which is placed pin side down on the base of the second die. Downward motion of the punch causes the end faces of the punch ring and crimp ring to abutt. At that point, further motion of the punch ring is prevented by the force of the second die spring biasing the crimp ring upwardly. However, the punch block is capable of continued downward motion by compressing the relatively weak springs between the moving block and stationary punch ring. Thus, the block pushes the artwork and shell partially out of the punch recess and into the counterbore of the crimp ring. The artwork edge strikes the counterbore tapered surface, which causes bending of the artwork edge around the shell edge and inside the crimp ring inner diameter until the shell edge contacts the tapered surface. The downward force of the punch increases until it exceeds the preload of the springs in the second die set. Additional punch stroke results in compression of the second die springs until the lip of the badge back folds the artwork around the shell edge and the shell and badge back make contact. At that point, the punch and punch ring both travel downwardly in unison with the crimp ring, which is forced downwardly with respect to the second die base against the relatively stiff base springs.

That action permits the bent artwork and shell edges to pass over the periphery of the badge back on the base support surface. Ultimately, the crimp ring bottoms on the flange face. At that point some relative travel between the punch and punch ring still remains. Further downward punch movement bends and crimps the shell edge inwardly to make contact with the tapered edge of the badge back. The final portion of punch stroke fully pushes the artwork and shell from the punch recess and into crimped assembly with the badge back to permanently secure the artwork between the shell and back.

Further in accordance with the present invention, the punch and two dies are interchangably usable with automatic, semi-automatic, and manually operated machines. The automatic machine of the present invention employs a single motor to reciprocate the punch and to index the dies into proper positions with respect to the punch, thereby insuring an accurate relationship between the punch and dies at all times. The motor drive is split into a first train for reciprocating the punch and a second train for indexing a die holding turntable in synchronization with the punch motions.

The automatic machines also include automatic means for ejecting completed badges from the assembly machine to a container. For that purpose, the drive train that operates the ram is adapted to additionally operate an air compressor. The second die base includes a passageway connected to the source of compressed air. A solenoid actuated valve is included in the circuit between the air compressor and the second die. The valve operates in syncronization with the punch motions, so that upon completion of the badge manufacturing cycle, air is blown through the second die base to the underside of the completed badge, thereby ejecting the completed badge assembly to the container.

The present invention is also concerned with a manually operated press for use in conjunction with the die set. The press includes a vertically reciprocable ram operated by means of an arm rotably mounted to a frame through a cam. The cam periphery is circular, and the cam high point bears against the ram at the lowermost portion of the ram stroke. As a result, the incremental cam forces on the ram follow a sinusoidal pattern, with the highest mechanical advantage occurring at the completion of the downstrokes.

Other advantages of the invention will become apparent from the disclosure.

DETAILED DESCRIPTION OF THE INVENTION

Figure 1:
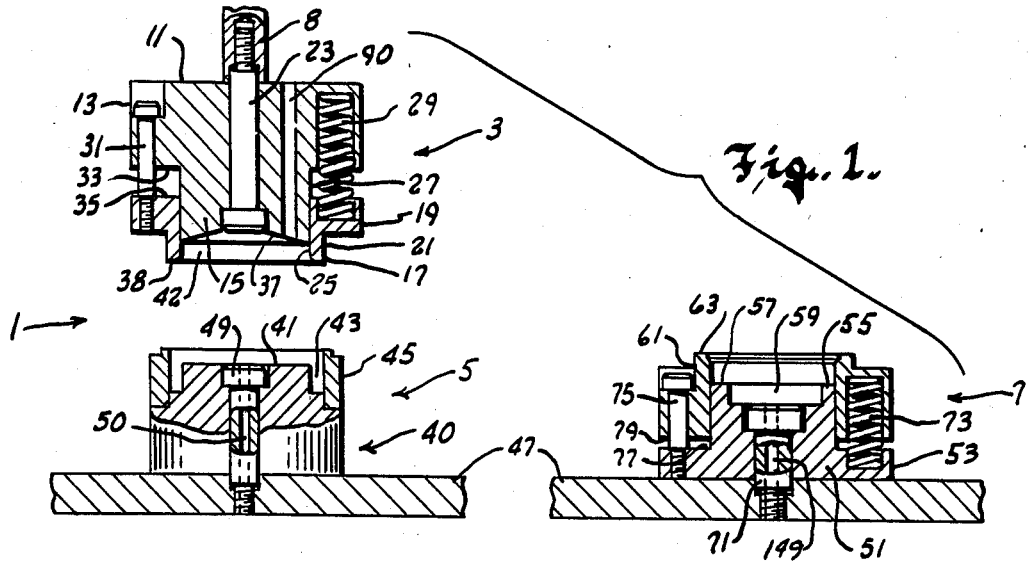
FIG. 1 is a cross-sectional view of the die set of the present invention.

Referring to FIG. 1, reference 1 indicates a badge manufacturing die set that includes the present invention. The die set is particularly useful for assembling multiple layers of thin materials into unitary laminated badges and buttons, but it will be understood that the invention is not limited to badge manufacturing applications The die set 1 is composed of a punch 3, a first die 5, and a second die 7. The punch 3 reciprocates vertically in a four stroke manufacturing cycle under the influence of a ram 8 that may be operated manually, as by a hand press 9, FIGS. 11 and 12. In the first portion of the cycle, the punch cooperates with the first die 5, FIGS. 3 and 4. In the second portion of the cycle, the punch cooperates with the second die 7, FIGS. 5–10.

Returning to FIG. 1, the punch 3 comprises a punch block 11 having a flange 13 and hub 15, and a punch ring 17 provided with a disk portion 19 and a hub 21. It is preferred that the outer peripheries of the block and punch ring be circular, but that shape is not essential to the invention. The block 11 is attached to the ram 8 for reciprocation therewith by a conventional fastener 23. In the illustrated construction, the punch ring 17 is formed with an inner diameter 25 that slides over the block hub outer diameter 27. A plurality of springs 29 are placed within aligned holes in the block and punch ring. The number of springs required is dependent on loads produced during the assembly process. To retain the punch ring on the block against the compressive force of the springs 29, shoulder screws 31, preferably three in number, are screwed into the punch ring disk 19 in alignment with counterbored holes in the block. In the preferred embodiment, the minimum distance between the faces 33 and 35 of the block flange and punch ring disk, respectively, is about 0.50 inches. The total initial force exerted by the retained springs on the block and punch ring with the 0.50 inch spacing between the faces 33 and 35 varies with badge size. For a popular size badge, the initial force, or preload, is about 100 pounds.

Figure 6:
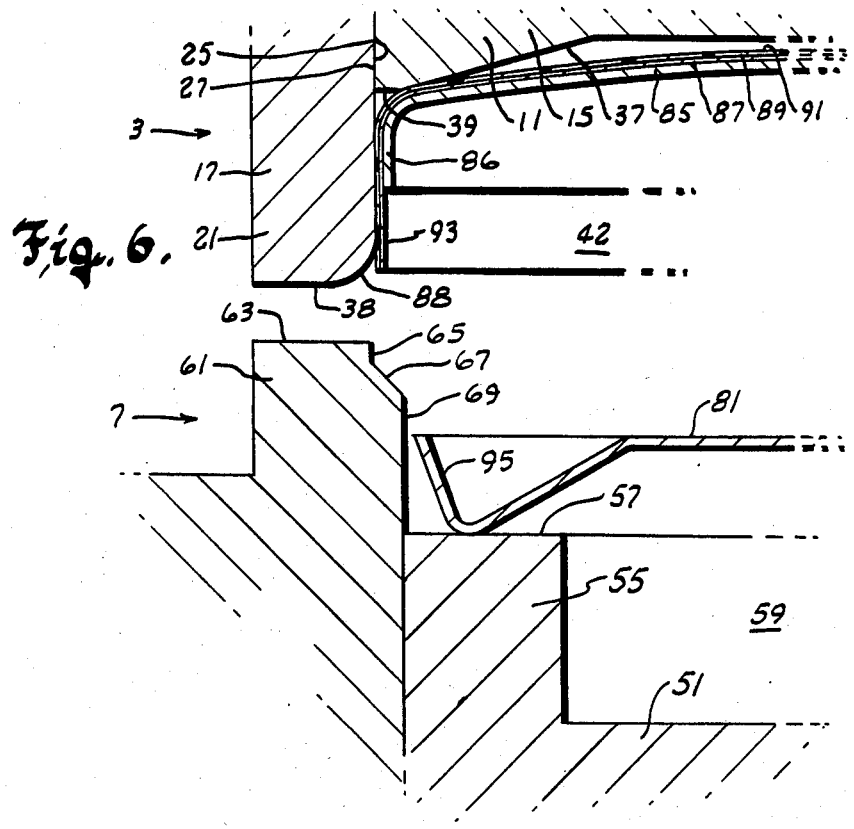
FIG. 6 is an enlarged partial cross-sectional view through the second die with the badge back in place showing the loaded punch in position thereabove.

The bottom face of the block hub 15 is formed with a shallow frusto-conical surface 37. As shown in FIG. 6, the base end of the frusto-conical 37 terminates radially inwardly from the hub outer diameter 27, so as to create a flat annular surface 39. In the initial conditions, the hub end face 38 extends about 0.25 inches beyond surface 39 to create a recess 42. In FIG. 1, the first die 5 comprises an anvil 40 having a horizontal flat support surface 41. Surrounding the support surface 41 is an annular groove 43. The outer limit of the groove 43 may be defined by a separate retainer ring 45 placed in an appropriate step in the anvil 40. Alternatively, the anvil may be manufactured with the ring 45 formed intergrally therewith. The anvil is secured to a plate 47 by a fastener 49. The fastener 49 is provided with a hole 50 extending longitudinally therethrough.

The second die 7 is comprised of a base 51 having flange 53 and a circular hub 55. The upper surface 57 of the base hub 55 defines a recess 59. Slidingly placed over the hub 55 is a crimp ring 61 having an upper face 63. As best shown in FIG. 6, crimp ring 61 is fabricated with a counterbore 65 that includes a tapered surface 67 connecting the counterbore 65 with the crimp ring inner diameter 69. The base 51 is secured to the plate 47 by a fastener 71, FIG. 1. Vertically aligned holes in the base flange 53 and crimp ring receive springs 73 that tend to raise the crimp ring off the base. The number of springs required is dependent on the loads produced during operation. The crimp ring is restrained against the springs 73 by shoulder screws 75. The initial distance between the flange face 79 and crimp ring face 77 varies with the size badge. For one particular size badge, the distance is approximately 0.13 inches. The compressive force in the restrained springs varies with badge size and operational loads, but the force in the springs 73 is always greater than the force in the punch springs 29. A typical initial force in the springs 73 may be about 350 pounds.

Figure 2:
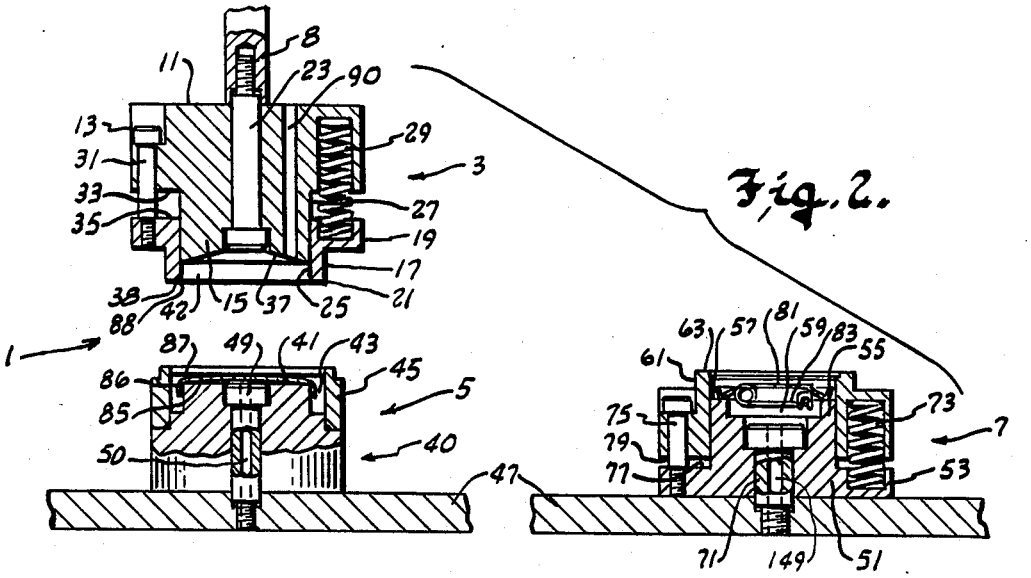
FIG. 2 is a cross-sectional view similar to FIG. 1, but showing the individual components of an unassembled badge loaded in the dies.

Turning to FIG. 2, the components of a badge or button are shown. Reference 81 indicates the badge back, to the backside of which is joined a pin 83, as is known in the art. A preformed shell 85 having a downturned edge 86, also known in the art and a layer of artwork 87 complete the badge components. It will be understood that the term "artwork" as used herein may include a thin sheet 89 of material bearing the design for incorporation into the badge and also a layer 91 of clear film for protecting the design sheet. See FIG. 6. As shown in FIG. 2, the badge back 81 is placed on the surface 57 of the base 51 with the pin 83 extending into recess 59. The shell 85 is placed backside down on the support surface 41 of the anvil 40. The artwork 87 is placed design side up on the shell 85. The inner diameter of the ring 45 centers the artwork on the shell.

Figure 3:
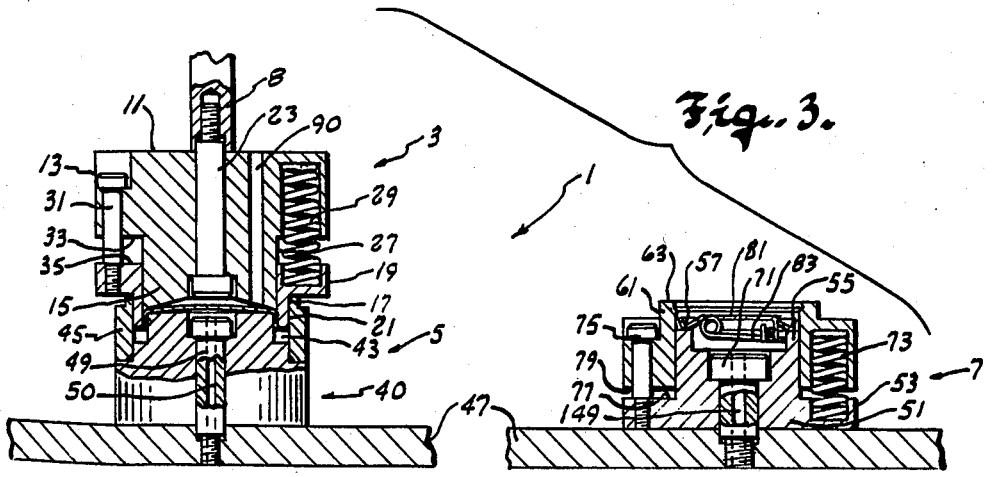
FIG. 3 is a cross-sectional view of the punch of the present invention in cooperation with the first die to load the badge shell and artwork into the punch.
Figure 4:
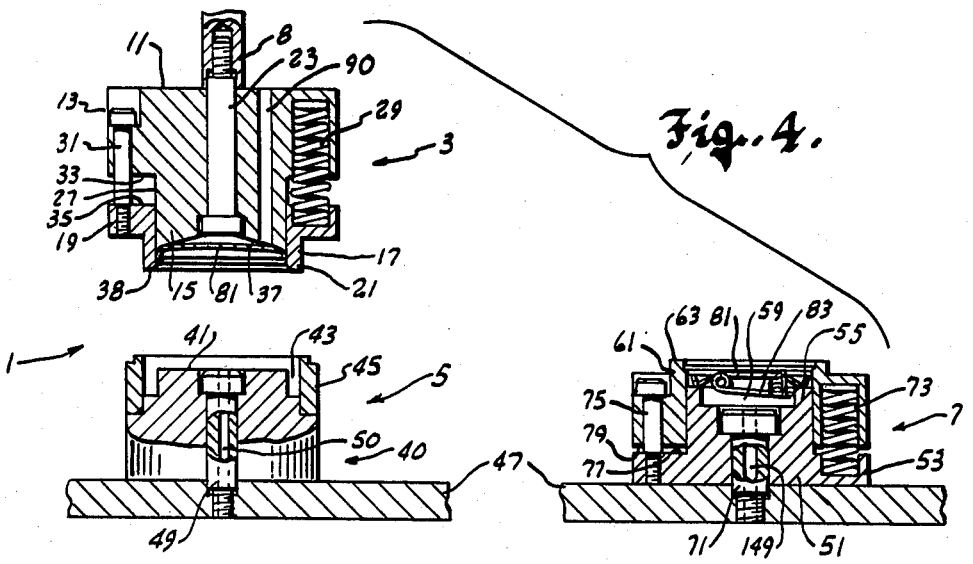
FIG. 4. is a cross-sectional view showing the punch and dies at the end of the loading portion of the manufacturing.

The badge manufacturing cycle begins with the loading portion of the cycle, wherein the shell 85 and artwork 87 are loaded into the punch 3. Referring to FIG. 3, the punch 3 is positioned directly over the first die 5. The ram 8, and hence the punch, is lowered until the punch hollow hub 21 enters the groove 43 snugly around the shell edge 86. To enter the groove 43, the hub bends the edge of the artwork 87 over the shell edge. To prevent damage to the artwork by the sliding thereover of the hub, a radius 88 is provided between the inner diameter 25 and face 38, FIG. 6. The resistence to bending provided by the artwork is minimal compared to the force exerted by the springs 29 on the punch ring 17. Therefore, the springs 29 do not compress during the loading stroke, FIG. 3. However, the snug fit of the hub inner diameter 25 on the shell edge, with the artwork therebetween, captures by friction the shell along with the artwork in the recess 42. Consequently, when the ram is withdrawn in a first withdrawal stroke, FIG. 4, the shell and artwork remain loaded in the punch for the next portion of the cycle.

To provide access to the captured shell and artwork, the punch block 11 defines a vertical passageway 90 therethrough. The access passageway 90 may be used to dislodge a shell and artwork that sticks in the punch recess 42. The passageway also serves as a vent to prevent air pressure buildup between the artwork 87 and surface 37, which would blow the artwork and shell 85 out of the recess 42.

Figure 5:
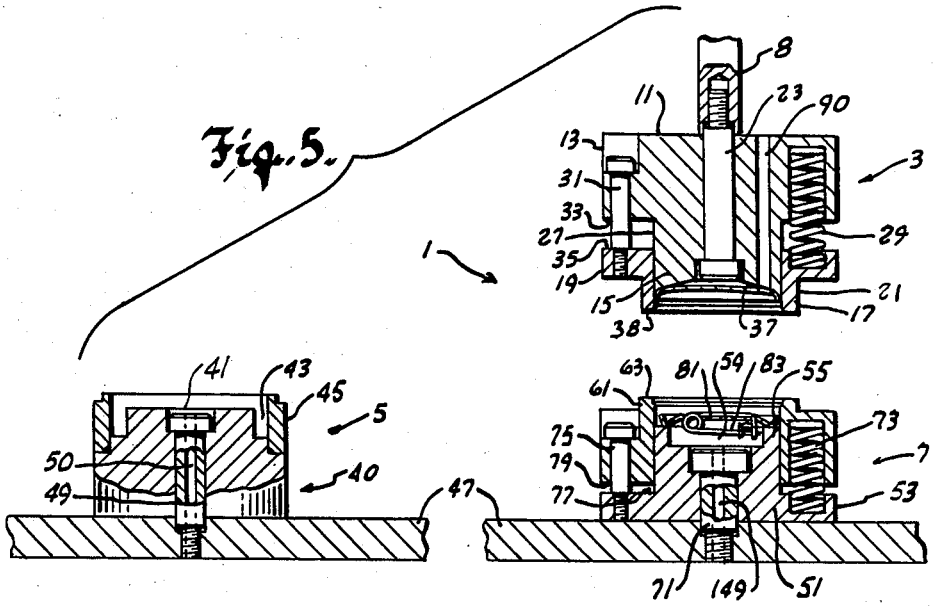
FIG. 5 is a cross-sectional view showing the loaded punch in position over the second die.

Referring to FIG. 5, it will be noticed that the punch 3, with the shell 85 and artwork 87 captured therein, is positioned vertically above the second die 7. Positioning of the ram 8 and punch relative to the dies 5 and 7 may be accomplished by holding the ram stationary and moving the plate 47, as will be explained hereinafter.

Referring to FIG. 6, the punch 3 is shown lowered to within a short distance above the die 7 during the assembly stroke.

Figure 7:
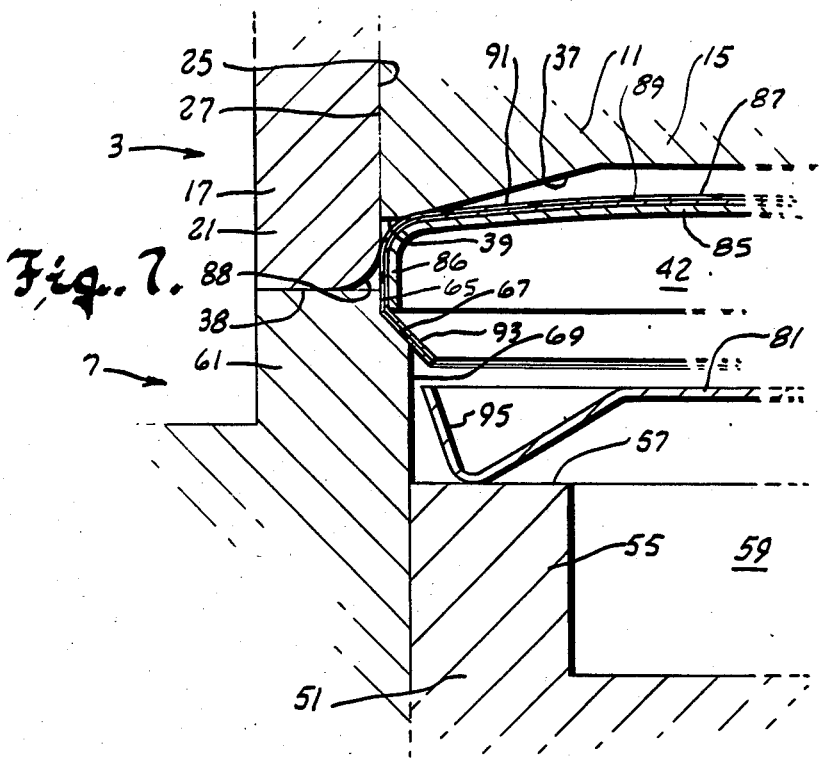
FIG. 7 is an enlarged partial cross-sectional view similar to FIG. 6, but showing the punch in cooperation with the second die during the intial phase of the assembly portion of the manufacturing cycle.

In FIG. 7, the punch 3 has contacted the die 7 during the assembly stroke. Specifically, the end face 38 of the punch ring hub 21 abuts the face 63 of the crimp ring 61. Further downward motion of the ram 8 (not illustrated) causes the punch block 11 to move downward correspondingly, but the punch ring 17 remains stationarily stopped against the crimp ring. That is because the springs 73 are stiffer than the springs 29, FIG. 5, so that downward motion of the punch block compresses the springs 29 between the faces 33 and 35, but the springs 73 are not compressed. As a result, the punch block pushes the shell 85 and artwork 87 partially from the recess 42 into the counterbore 65 of the crimp ring, FIG. 7. The edge 93 of the artwork strikes the tapered surface 67, resulting in the edge 93 becoming bent inwardly under the shell edge 86 and inside the crimp ring inner diameter 69.

Figure 8:
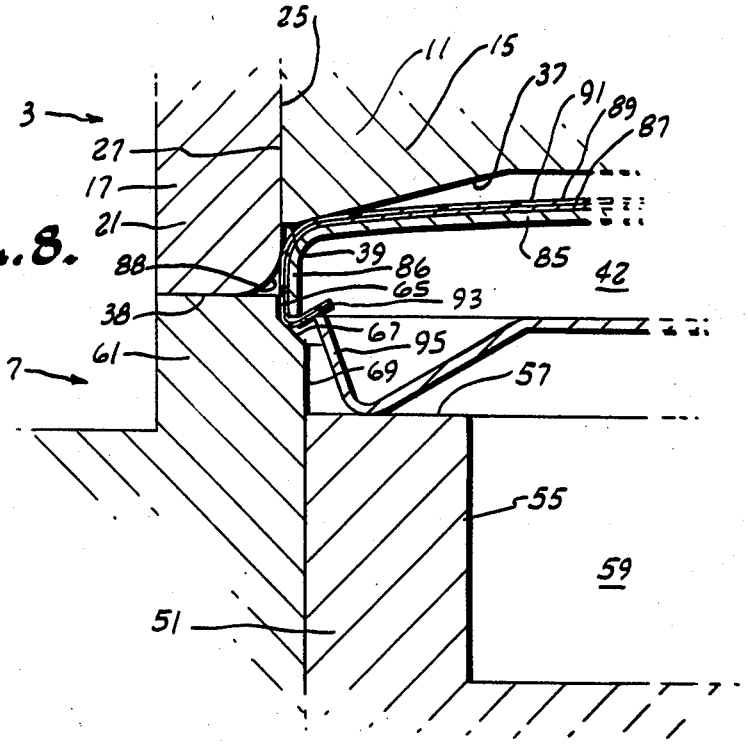
FIG. 8 is a view similar to FIG. 7, but showing a subsequent relation of the punch and second die.

As the punch block 11 descends relative to the punch ring 17, the punch springs 29 compress until the shell edge 86 and artwork 87 contact the tapered surfaces 67. The downward force of the punch increases until it exceeds the preload of the springs 73. The compressive force exerted thereby, in one application, reaches about 350 lbs. (Refer to FIG. 5.) It is preferred that the block travel relative to the punch ring to attain the preload force is about 0.19 inches. At that point, when the downward force of the ram 8 equals the force in the restrained springs 73, further downward motion by the ram causes both the punch ring and the crimp ring 61 to move in unison downwardly against the springs 73 relative to the stationary base 51 and badge back 81. The punch block continues to slide downwardly relative to the punch ring and crimp ring. As a result, as shown in FIG. 8, the downward motion of the crimp ring causes the shell and artwork to be further lowered over the badge back until the edge 93 is caught between the lip 95 of the badge back and the shell edge 86.

Figure 10:
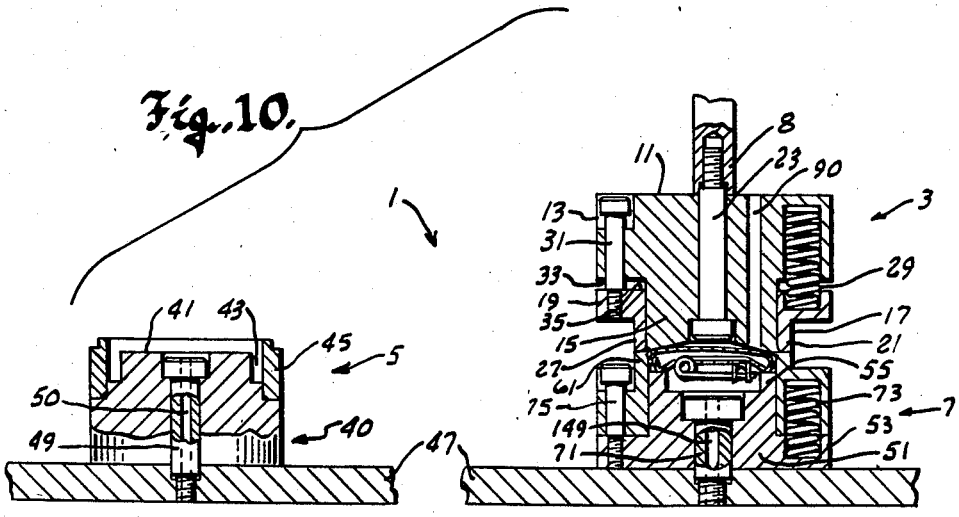
FIG. 10 is a cross-sectional view of the punch and die of the present invention in the position of complete assembly of the badge.
Figure 9:
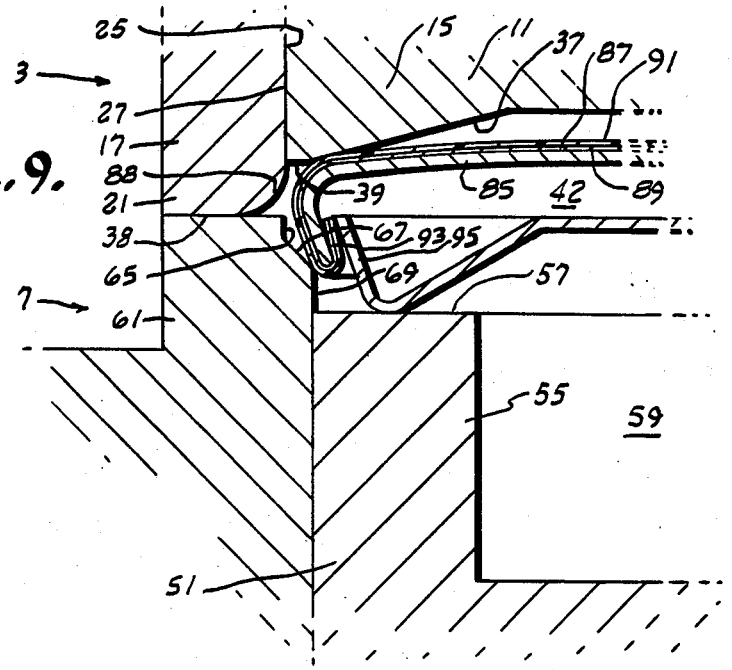
FIG. 9 is a view similar to FIG. 8, but showing the relative locations of the punch and second die just prior to complete assembly of the badge.

As the ram 8 and punch block 11 travel still farther downwardly, the punch block pushes the shell 85 and artwork 87 further out of the recess 42 until the crimp ring 61 ultimately bottoms on the flange face 77, FIGS. 9 and 10. Consequently, the flange 53, crimp ring, and punch ring 17 act as a solid column. Further downward movement of the ram and punch block causes the shell and artwork to be pushed farther out of the recess 42 and the shell edge 86 to bend inwardly under the influence of the tapered surface 67. The final downward movement of the ram and punch block pushes the edges 86 and 93 into tight crimping contact over the badge back lip 95, thereby holding the badge assembly together. The maximum downward movement of the ram and punch block is adjustable to control the tightness of the crimping in the assembled badge.

As illustrated in FIG. 10, it is preferable that a small amount of clearance remain between the faces 33 and 35 at the completion of the assembly stroke. Withdrawal of the punch upwardly leaves the badge on the surface 57 of the base 51, FIG. 9.

Figure 12:
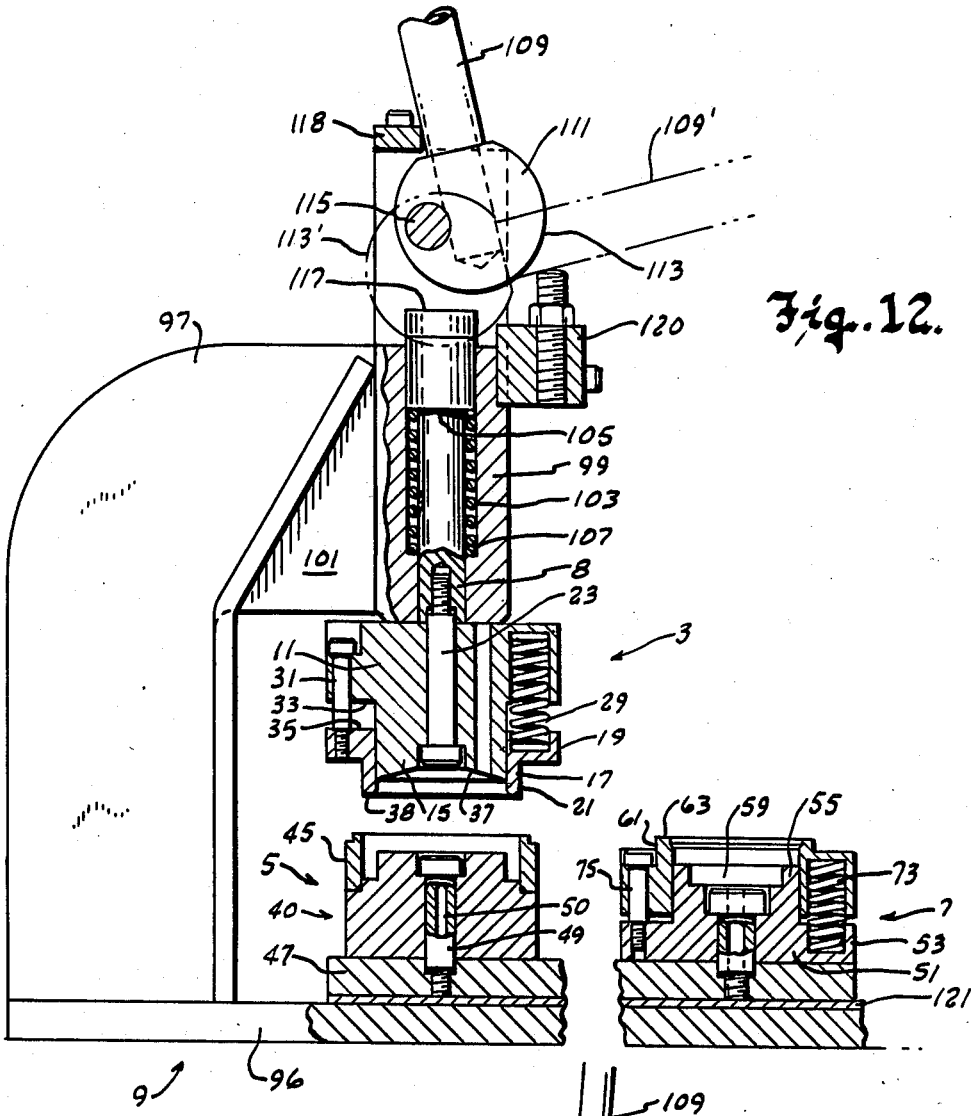
FIG. 12 is a cross-sectional view of the machine of FIG. 11 showing the punch and dies mounted thereto.
Figure 11:
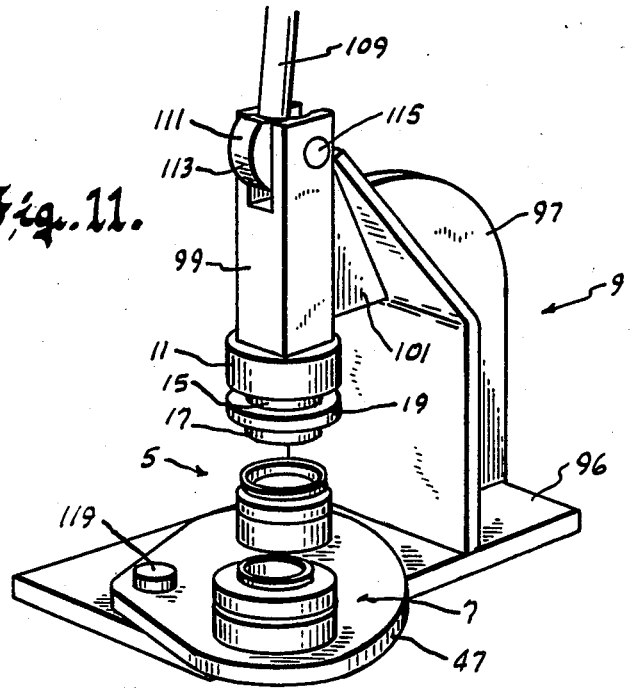
FIG. 11 is a perspective view of a manually operated machine for manufacturing badges.

Turning now to FIGS. 11 and 12, a manually operated press 9 is shown that is advantageously used with the die sets 1 of the present invention. The press includes a base 96 and an upstanding L-shaped frame member 97. A housing 99 is joined to the frame 97 through a plate 101. Mounted within the housing 99 for vertical reciprocation therein is the ram 8 to the lower end of which is fastened the punch 3 by the screw 23. The ram and punch are biased upwardly by spring 103 acting between shoulders 105 on the ram and 107 on the housing. To force the ram and punch downwardly against the spring 103 an arm 109 is journaled in a pin 115 mounted to the housing through a cam 111. Rotating the arm 109 clockwise with respect to FIG. 12 causes the cam circular periphery 113 to contact the upper surface 117 of the ram to force it downwardly. Stop 118 limits arm rotation in the counterclockwise upstroke direction. Adjustable stop 120 limits arm rotation on the downstrokes. It is preferred that the cam be made of an anti-friction material and that the ram surface 117 be of hardened steel. That combination of materials gives long service life and requires minimal lubrication.

To minimize the force required to operate the press 9 with acceptable arm travel, the high point of the cam periphery 113 relative to the pin 115 contacts the ram surface 117 at the completion of the assembly stroke, where the resistance to punch movement is greatest because of the compressive forces in the springs 29 and 75 and the crimp ring of the badge components into a badge assembly. As the arm 109 and cam 111 rotate, the cam circular periphery causes a variation in ram motion for a constant arm motion, thus producing a variable mechanical advantage. The relatively great rotational motion of the arm at the conclusion of the downward storke, as shown by the phantom lines 109' and 113', thus produces a relatively small vertical motion in the ram. The high mechanical advantage at that point in the cycle permits badge manufacturing on a continuous high speed basis with a minimum of operator fatigue.

To selectively position dies 5 and 7 under the punch 3, the dies are fastened to a plate 47 that is pivotable about a pin 119 secured to the press base 96. The plate may be restrained in the two proper alignment positions by detents of known construction, not shown. To maximize press life and to minimize friction when positioning the dies, the underside of the plate is provided with an anti-friction liner 121. Alternatively, the liner 121 may be secured to the upper surface of the base 96. If desired, the plate 47 may include a handle of suitable construction, not illustrated in FIGS. 11 and 12, to facilitate pivoting the plate.

Figure 13:
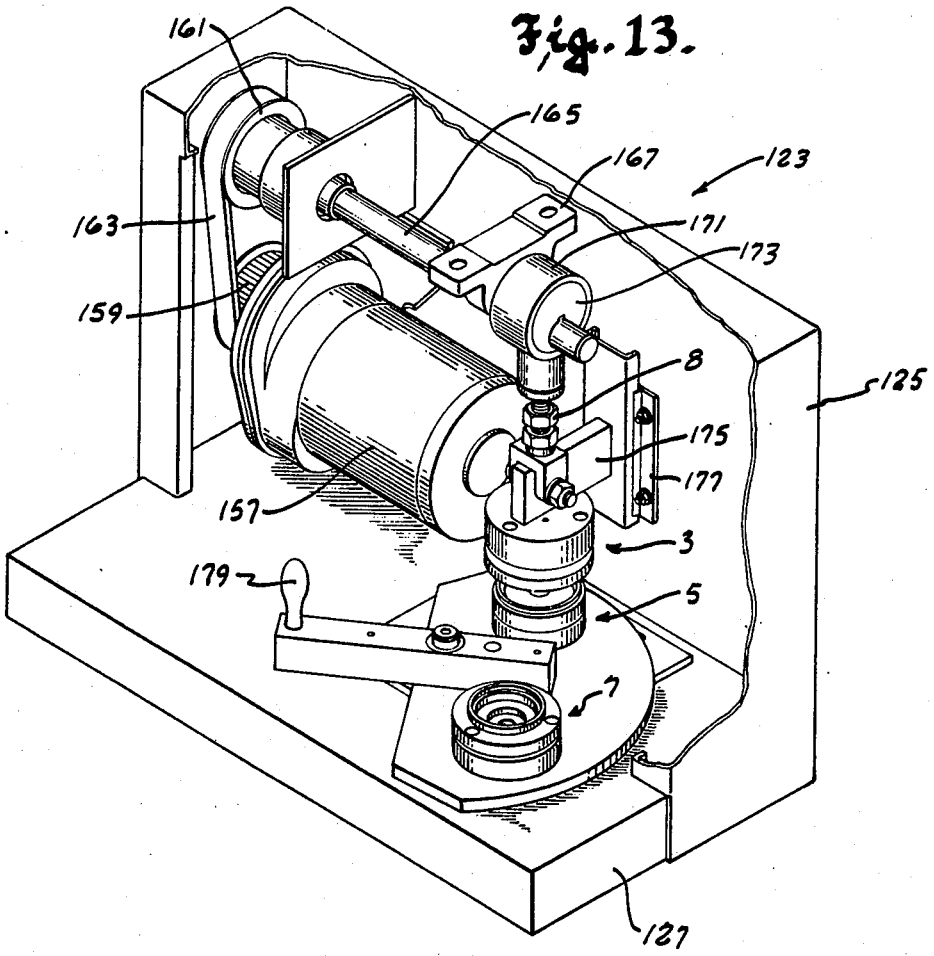
FIG. 13 is a partially broken perspective view of a semi-automatic machine for assembling badges according to the present invention.

It is a feature of the present invention that the badge manufacturing die set 1 is interchangeable between manual, semi-automatic, and automatic badge making machinery. Referring to FIG. 13, a semi-automatic machine 123 is depicted that employs the punch 3 and dies 5 and 7 of the present invention. The apparatus for reciprocating the ram 8 includes an electric motor 157, pulleys 159 and 161, and a belt 163. Pulley 161 is mounted on a shaft 165 that rotates within conventional bearings 167 attached to the upper portion, not shown, of the machine frame 127. An eccentric carrier 171 is used to mount an eccentric 173 to the shaft 165. The eccentric carrier 171 constitutes a portion of the ram, which further includes a slide member 175 that is guided within a slide guide 177. The punch 3 is preferably attached to the lower end of the slide 175. The components for vertically powering the ram are safely covered with cover 125.

The dies 5 and 7 are fastened to a plate 47 by the screws 49 and 71, respectively, (FIG. 1), as previously described. The plate 47 is pivotable about a center pin, not illustrated in FIG. 13, so as to selectively position either die 5 or 7 under the ram 8. A handle 179 facilitates the die positioning.

Figure 14:
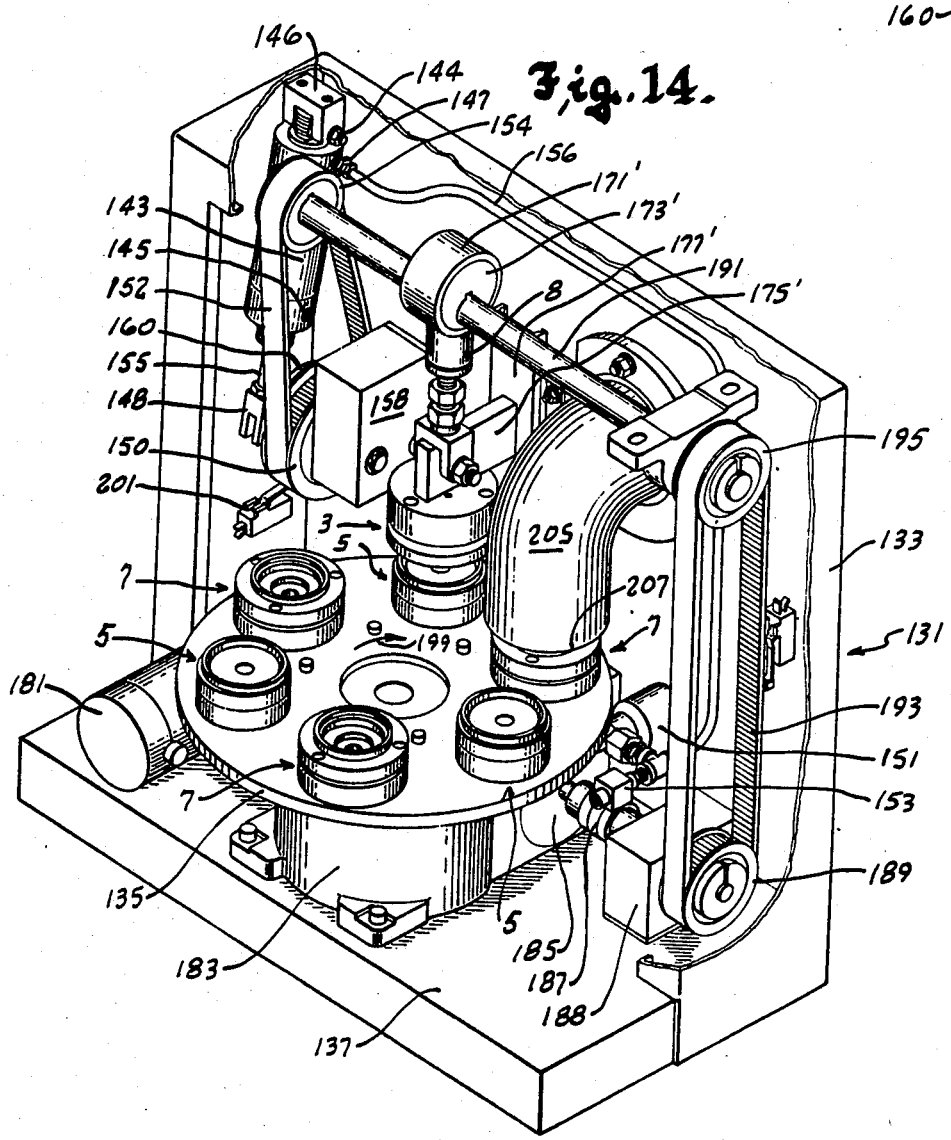
FIG. 14 is partially broken perspective view of an automatic machine for assembling badges.

In FIG. 14, a fully automatic badge making machine 131 is shown. In the preferred embodiment, the automatic machine 131 includes a frame 137 that supports a conventional electric motor 181 and a turntable 135. The turntable 135 corresponds to the plate 47 of FIGS. 1 and 13. The turntable is supported and driven by an indexing device 183 of known construction that is driven by the output shaft of the motor 181. Preferably, the motor is a variable speed motor. A known right angle drive may be used to mechanically connect the input of the indexing device 183 to the motor shaft. The motor further powers a second drive train through a speed reducer 185. The second drive train includes a shaft and coupling 187 extending from the speed reducer 185 and supported by a bearing block 188. To the end of the shaft 187 is mounted a pulley 189 that drives a second shaft 191 through a timing belt 193 and a second pulley 195. Mounted to the shaft 191 is the ram 8, which comprises an eccentric 173' carried by an eccentric carrier 171' and a slide 175' guided in a slide guide 177' as described previously with respect to the semi-automatic machine 123. The power operated mechanisms for reciprocating the ram and for indexing the turntable 135 are safely covered by cover 133. The turntable may be recessed into a horizontal cover 197. (Not shown)

For maximum production, the automatic machine 131 preferably utilizes more than one pair of dies 5 and 7. As shown in FIG. 14, three pairs of dies may be installed in the turntable 135. The dies are alternated.

In operation, the turntable 135 indexes automatically in direction of arrow 199 in synchronization with the ram motions such that the turntable rotates to present a new die to the punch after each down and up stroke. The badge components are loaded manually in the dies 5 as previously described, but the die alignment under the punch 3 is completely automatic. Thus, the single power source 181 both reciprocates the ram 8 and indexes the turntable 135, thereby insuring that the ram and turntable are always perfectly timed. For each revolution of the turntable, three badges are assembled for the configuration shown in FIG. 14.

Figure 15:
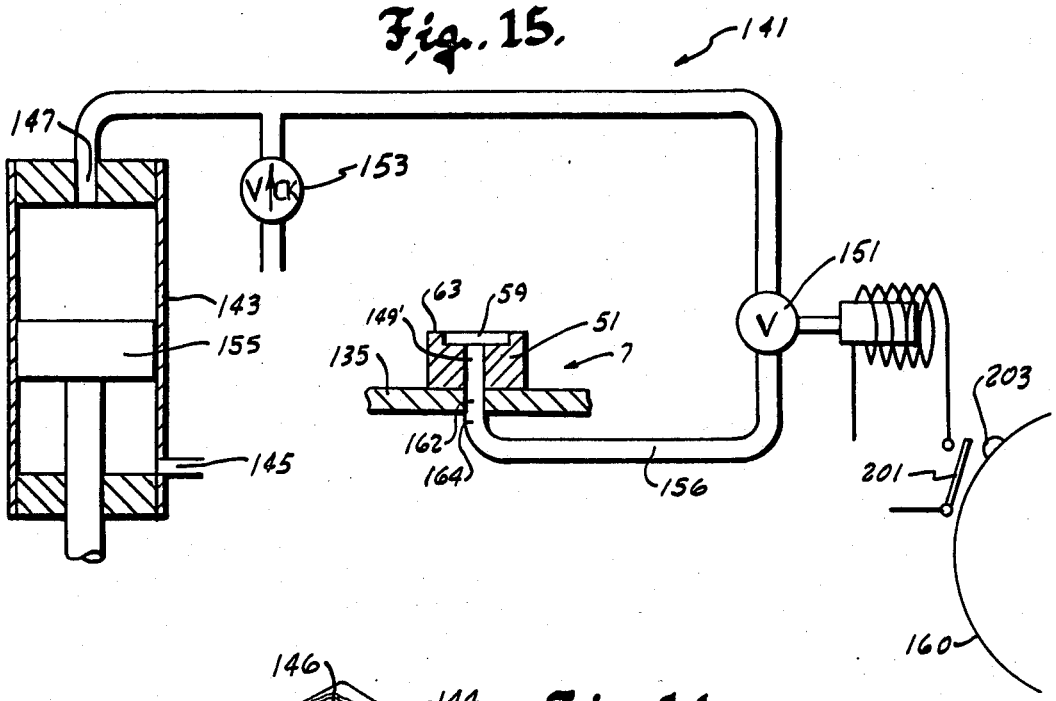
FIG. 15 is schematic view, partially in cross-section, of a badge ejecting circuit according to the present invention.

Further in accordance with the present invention, the completed badges are automatically removed from the second die 7 at the completion of a manufacturing cycle. For that purpose, an automatic pneumatic circuit 141, as illustrated in FIG. 15, is used in connection with the die 7. The circuit 141 includes a source of compressed air, which preferably is a conventional single acting cylinder 143. Also see FIG. 14. The cylinder 143 has a closed end mounted for oscillating motion by a pin 144 to a block 146 attached to the machine frame 137. The cylinder piston 155 is reciprocated by means of a clevis 148 pivotally connected to a spacer not illustrated in FIG. 14 but shown as reference number 160 in FIG. 15. The spacer 160 is secured to a pulley 150. The pulley 150 is mounted for rotation in a bearing block 158 fastened to the frame 137. The pulley 150 is driven by a timing belt 152 and a pulley 154 mounted to the shaft 191. Pulley 150 is twice the diameter of pulley 154. The piston 155 thus reciprocates in timed relation with the ram 8, but at one-half the speed of the ram.

The cylinder 143 has the usual atmospheric port 145 and working port 147. The working port 147 is connected to the base 51 of each die 7 by a tubing 156. Turning back to FIGS. 1–5 and 10, it will be noticed that the fastener 71 that secures the base 51 to the plate 47 or turntable 135 is formed with an axial passage 149 therethrough. The upper end of the passage 149 terminates in the base recess 59. The passage is shown schematically as reference numeral 149' in FIG. 15. The lower end of passage 149' communicates with a turntable port 162. The open end 164 of the tubing 156 is stationarily located under the turntable such that the tubing 156 communicates with the turntable port 162 when the turntable is indexed to a position where a die 5 is positioned under the ram 8. A seal of suitable construction, not shown, may be utilized at the junction between the ports 162 and tubing end 164.

To control the flow of air from the cylinder to the recess 59, a two position solenoid valve 151 is inserted in the circuit. A check valve 153 is also included in the circuit. In operation, on the cylinder intake stroke the solenoid valve 151 is closed and the check valve 153 is open to atmospheric pressure. On the compression stroke, the check valve closes, and the solenoid valve remains closed to build up air pressure throughout the circuit 141 between the cylinder and solenoid valve. Thus, the circuit between the cylinder and solenoid valve acts as an accumulator. The piston strokes are timed with the ram strokes such that the piston is at top dead center, and thus the circuit pressure is a maximum, when the ram is at bottom dead center of the assembly stroke. The solenoid valve is controlled such that, at bottom dead center of the assembly stroke, the solenoid valve is energized to open. For that purpose, a switch 201 is used in conjunction with a trip 203 mounted to the spacer 160. The trip 203 may be located on the spacer periphery. The trip actuates the switch 201 to open the solenoid valve when the ram 8 is at bottom dead center of alternate strokes. Accordingly, the compressed air in the circuit rushes through the passage 149 to the recess 59 behind the assembled badge, not shown in FIG. 15. The badge is thereby blasted off the base face 63.

To transfer the completed badge to the next station for further processing, a chute 205 is fixed to the automatic machine frame 137. In the construction illustrated in FIG. 14, the chute 205 is formed as a duct of relatively large diameter. The duct has an open end 207 that closely fits over the top of a die 7 when the turntable 135 is indexed such that a die 5 is positioned under the ram 8. Thus, when the turntable is indexed to the position shown in FIG. 14, air from the compressor 143 is directed to the passage 149' to eject a completed badge from the die 7 into the chute.

Thus, it is apparent that there has been provided, in accordance with the invention, a die set apparatus for manufacturing badges that fully satisfies the objects, aims, and advantages set forth above. While the invention has been described in connection with specific embodiments thereof, it is evident that many alternatives, modifications, and variations will be apparent to the man skilled in the art in light of the foregoing description. Accordingly, it is intended to embrace all such alternatives, modifications, and variations as fall within the spirit and broad scope of the appended claims.

I claim:

1. A die set for manufacturing badges from a plurality of badge components comprising:

a. first die means for supporting at least one first badge component;

b. second die means including a pair of relatively reciprocable members for supporting at least one second badge component;

c. punch means including a pair of relatively reciprocable members for vertical reciprocation in alignment with a selected first and second die means and for cooperating with the first die means to load the first badge component in the punch means and with the second die means to push the first badge component from the punch means and into assembled relationship with the second badge component; and wherein:

d. the second die means comprises:

i. a base for supporting the second badge component;

ii. a crimp ring having an end face and adapted to reciprocate on the base, the crimp ring being biased upwardly relative to the base with a first force; and iii. fastener means for restraining the crimp ring in a predetermined location relative to the base against the first force; and e. the punch means comprises:

i. a block having an end face;

ii. a punch ring adapted to reciprocate on the block and having an end face adapted to abut the crimp ring end face, the punch ring being biased downwardly relative to the block with a second force that is less than the first force; and iii. fastener means for restraining the punch ring on the block in a predetermined location relative thereto against the second force.

2. The die set of claim 1 wherein the punch ring extends beyond the block end face to form a recess for receiving the first badge component loaded in the punch means.

3. The die set of claim 2 wherein the punch ring and crimp ring end faces abut during punch means downward movement to initially prevent downward motion of the punch ring and permit block movement downward against the first force, and wherein subsequent block movement downward overcomes the second force to permit downward motion of the crimp ring and punch ring relative to the block and second die means base.

4. A die set for manufacturing badges and buttons from a back having a pin thereon, a shell, and artwork comprising:

a. a first die having a support surface for supporting the badge shell, the artwork being overlaid on and overhanging the shell;

b. a second die comprising:

i. a base having a surface for supporting the badge back;

ii. a crimp ring slidably mounted over the base, the crimp ring having an upwardly extending hollow hub terminating in an end face, the hollow hub defining a counterbore terminating in a tapered surface;

iii. first spring means having a first spring constant interposed between the base and crimp ring for biasing the crimp ring slidingly upwardly on the base; and iv. fastener means joining the base to the crimp ring for restraining the first spring means from forcing the crimp ring off the base; and c. punch means for vertical reciprocation in selected alignment above the first and second dies comprising:

i. a punch block having a downwardly facing end face;

ii. a punch ring slidably mounted over the punch block and having a downwardly extending hollow hub terminating in an end face extending beyond the punch block end face to create a recess, the hollow hub being adapted to surround the badge shell placed on the first die support surface and to abut the first die hollow hub end face;

iii. second spring means interposed between the punch block and punch ring for biasing the punch ring slidingly downwardly off the punch block, the second spring means having a lesser spring constant than the first spring means; and iv. fastener means joing the punch block and punch ring for restraining the first spring means from forcing the punch ring off the punch block, so that the punch means hollow hub bends the artwork over the badge shell and snugly grips the shell periphery when the punch means is lowered onto the first die to load the artwork and shell into the punch means recess and the punch means hollow hub end face abuts the crimp ring end face when the punch means is lowered onto the second die to initially restrain the punch ring against vertical movement as the punch block descends to compress the second spring means and push the shell and artwork out of the punch means recess against the crimp ring tapered surface to inwardly bend the shell and artwork edges and continued motion of the punch block subsequently causes the punch and crimp ring to move downwardly together against the first spring means to thereby lower the shell and artwork over the badge back for assembly thereto.

5. The die set of claim 4 wherein the first and second dies are fastened to a common plate that is positionable into vertical alignment of a selected die with the punch means.

6. The die set of claim 4 wherein the first die comprises:

a. a base having a supporting surface for supporting the badge shell and artwork; and b. a retainer ring spaced from the support surface periphery to cooperate therewith to create an open top groove therebetween for receiving the hollow hub of the punch means punch ring.

7. The die set of claim 4 wherein the second die base support surface defines a recess for receiving the pin on the badge back.

8. The die set of claim 4 wherein:

a. the second die base is formed with a flange defining a plurality of holes and having a flange face;

b. the second die crimp ring defines a face parallel and facing the base flange face and defining a plurality of holes aligned with the base flange holes for receiving the first spring means therein; and c. the second die fastener means are adapted to restrain the crimp ring on the base with about 0.13 inches clearance between the flange and crimp ring faces.

9. The die set of claim 8 wherein the force exerted by the first spring means is about 350 lbs. when the clearance between the base and crimp ring faces is about 0.13 inches.

10. The die set of claim 4 wherein the end face of the punch means punch block defines a frustoconical surface to facilitate loading and retaining the shell and artwork in the punch means recess.

11. The die set of claim 4 wherein the punch means punch block defines a passageway therethrough communicating with the punch means recess to provide access to a shell and artwork loaded in the punch means.

12. The die set of claim 4 wherein:

a. the punch means punch block is formed with a face defining a plurality of holes;

b. the punch means punch ring includes a disk portion defining a plurality of holes aligned with the holes of the punch block for receiving the second spring means; and c. the punch means fastener means are adapted to restrain the punch ring on the punch block with about 0.50 inches clearance between the disk and block face.

13. The die set of claim 12 wherein the force exerted by the second spring means is about 100 lbs. when the clearance between the disk portion and block face is about 0.50 inches.

* * * * *